United States Patent [19]

Mastrodicasa

[11] Patent Number: 4,527,697

[45] Date of Patent: Jul. 9, 1985

[54] DISPLAY FIXTURE

[76] Inventor: Arthur R. Mastrodicasa, 5 Elmcrest Cir., Walpole, Mass. 02081

[21] Appl. No.: 627,236

[22] Filed: Jul. 2, 1984

[51] Int. Cl.[3] ..... A47B 47/00

[52] U.S. Cl. ..... 211/189; 312/202

[58] Field of Search ..... 211/189, 163, 177, 94, 211/133, 131; 312/202; 49/465; D80/9; D6/1; 403/6; 40/489, 490, 486, 488; 29/453, 562 R

[56] References Cited

U.S. PATENT DOCUMENTS

| | | | |
|---|---|---|---|
| D. 181,553 | 11/1957 | Shurtleff | D80/9 |
| D. 185,763 | 1/1959 | King, Jr. | D80/9 |
| D. 216,749 | 3/1970 | Welch | D6/1 |
| 1,677,318 | 7/1928 | Alexander | 211/163 X |
| 2,950,155 | 8/1960 | Schick | 211/163 X |
| 3,092,258 | 6/1963 | Bleed | 211/163 |
| 3,502,226 | 3/1970 | Marschak | 211/163 |
| 3,931,894 | 1/1976 | Murphy | 211/189 |
| 4,420,087 | 12/1983 | Johns | 211/189 |

FOREIGN PATENT DOCUMENTS

| | | | |
|---|---|---|---|
| 1483056 | 8/1977 | United Kingdom | 211/163 |

*Primary Examiner*—Ramon S. Britts
*Assistant Examiner*—Sarah A. Lechok

[57] ABSTRACT

A display fixture comprising a base member, a channel member upstanding from the base member and panel members fixed to the channel member and extending outwardly therefrom, the panel members and base member defining a plurality of display areas; and a method for assembling the fixture.

8 Claims, 5 Drawing Figures

DISPLAY FIXTURE

BACKGROUND OF THE INVENTION

1. Field of the Invention

The invention relates to display fixtures and is directed more particularly to a fixture having a plurality of display areas. The invention further relates to a method for assembling the fixture.

2. Description of the Prior Art

Display fixtures of the type having a base member, a central post or column upstanding from the base member, and wings, or panel members, extending outwardly from the central column are generally known in the art. Examples of such fixtures may be seen in U.S. Pat. Nos. 2,950,155; 3,092,258; 3,502,226 and 3,931,894.

SUMMARY OF THE INVENTION

An object of the present invention is to provide a display fixture having a plurality of display areas and of such construction as may be shipped with its components unassembled and be readily assembled at the point of use.

A further object of the invention is to provide a method by which a display fixture may be easily and quickly assembled at the point of use.

With the above and other objects in view, as will hereinafter appear, a feature of the present invention is the provision of a display fixture comprising a base member having a substantially planar surface, a hollow channel member fixed to the base member and upstanding therefrom, the channel member having a plurality of planar side walls and a last planar side wall, a panel member fixed to each of the plurality of planar side walls, respectively, fastener members extending through the panel members and the plurality of side walls into the channel member, fastener lock members disposed on the fastener members within the channel member, the channel member having a free end adapted to be open for access to a portion of the fastener members and manipulation of a portion of the fastener lock members, the last planar side wall having an opening therein near its end remote from its free end, the opening being adapted for access to a remainder of the fastener members and manipulation of a remainder of the fastener lock members, and a last panel member, clip means fixed to the last panel member thereof, the opening being adapted to receive the clip means, the last side wall adjacent the opening being adapted to interconnect with the clip means to retain the last panel member on the last side wall.

In accordance with a further feature of the invention there is provided a method for assembling the above-described display fixture, the method including the steps of (1) providing a base member having a substantially planar horizontal surface, (2) attaching to the base member a hollow plural-sided channel member with the channel member upstanding from the planar surface, the channel member being open at its upper end, the channel member having in each of its plurality of sides holes adapted to receive fastener members, the channel member having an opening therein proximate the lower end of the channel member, (3) joining to each of the plurality of sides a panel, each of the plurality of panels having holes therein alignable with the channel member holes and adapted to receive fastener members, (4) inserting fastener members through the panel holes and the channel member holes, free ends of the fastener members being disposed in the hollow channel member, (5) by access through the open upper end of the channel member attaching locking members to a portion of the fastener member free ends to secure the panels to the channel member sides, (6) by access through the channel member opening attaching locking members to a remainder of the fastener member free ends to further secure the panels to the channel member sides, (7) providing a last panel having fixed thereto a clip member adapted to engage portions of a last channel member side wall adjacent the opening, and (8) inserting the clip member in the opening to clip the last panel to the last side by engagement of the clip member with the last side wall portions adjacent the opening.

The above and other features of the invention, including various novel details of construction and combinations of parts, will now be more particularly described with reference to the accompanying drawings and pointed out in the claims. It will be understood that the particular device and method embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent. In the Drawings.

DESCRIPTION OF THE PREFERRED EMBODIMENT

Figure 1:
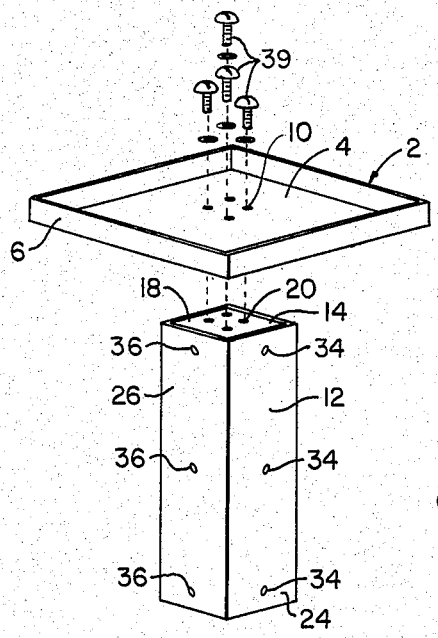
FIG. 1 is an exploded perspective view illustrating the joining of the base and channel members.

Referring to the drawings, it will be seen that an illustrative embodiment of the display fixture includes a base member 2 including a floor portion 4 and wall portion 6 extending normal to the floor portion which is provided with a substantially planar surface 8. The floor portion 4 of the base member 2 is provided with hole means 10 therein.

The display fixture is further provided with a hollow channel member 12, preferably four-sided, with a first end 14 closed and a second end 16 open. The first end 14 is closed by substantially planar end wall 18 having hole means 20 therein, the channel member and wall hole means 20 being alignable with the base member floor portion hole means 10. The four side walls 22, 24, 26, 28 of the channel member 12 are preferably planar and are provided with hole means, respectively 32, 34, 36, 38.

Figure 3:
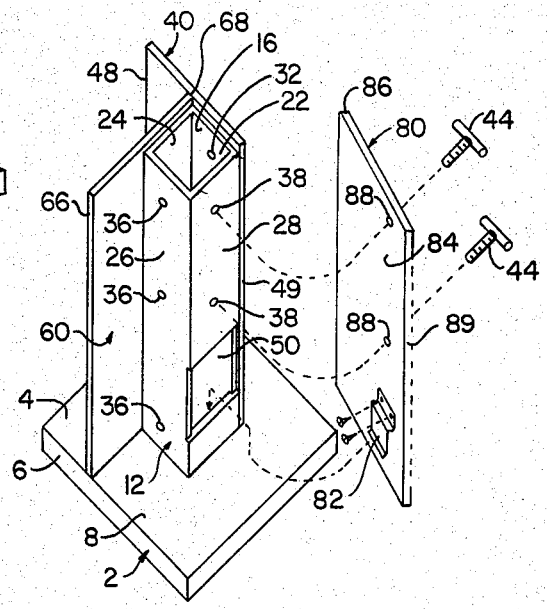
FIG. 3 is an exploded perspective view illustrative of the manner in which a last panel is attached to the channel member.
Figure 4:
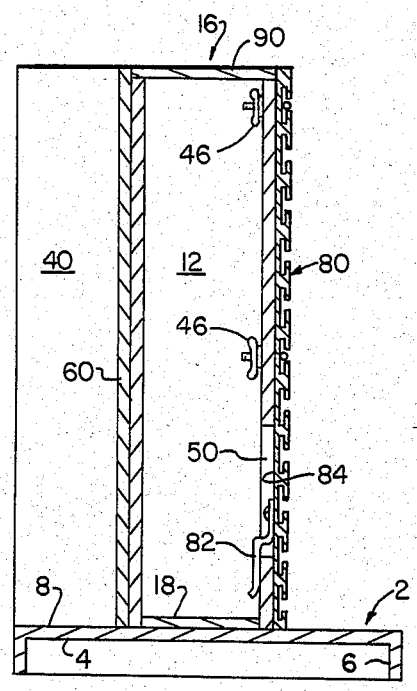
FIG. 4 is a sectional view, taken along line IV—IV of FIG. 5.
Figure 5:
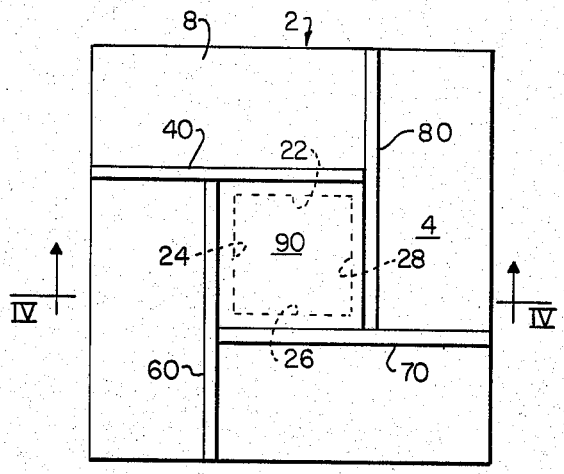
FIG. 5 is a top plan view of the completed display fixture assembly.
Figure 2:
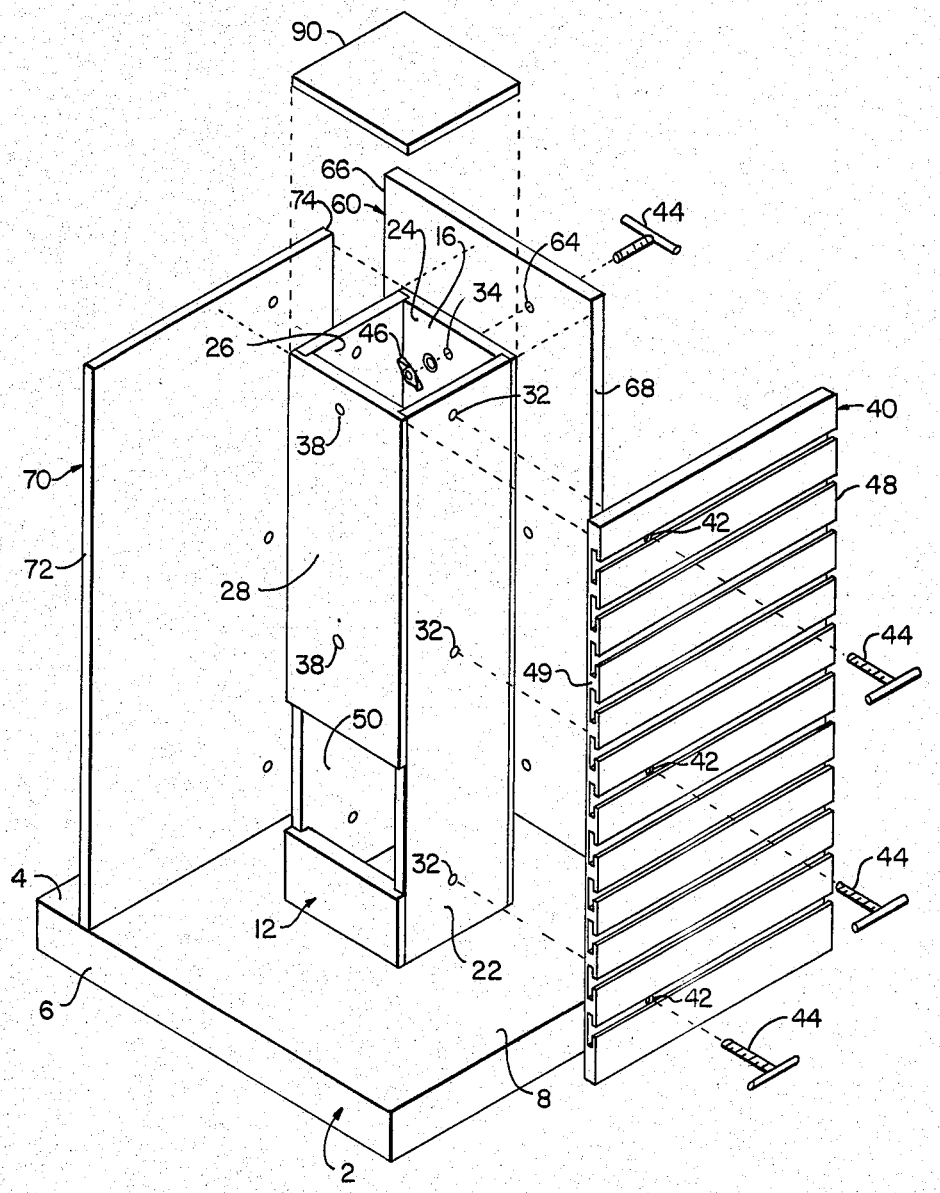
FIG. 2 is an exploded, perspective view illustrative of the manner in which a plurality of panels are attached to the channel member.

In assembling the fixture, screws 39 are screwed into aligned hole means 10, 20, as illustrated in FIG. 1, to connect the channel member 12 to the floor portion 4. The two-piece assembly is then inverted to the position shown in FIGS. 2–4, with the channel member 12 upstanding from the base member 2.

A first panel member 40, having holes 42 therein alignable with holes 32 of the channel member first side 22, is attached to the channel member first side by fastener members, such as screws 44, extending through the holes 42, 32. Fastener lock members, such as wing-nuts 46, may be attached to the free ends of the upper two screws 44, inside the channel member 12, by access through the channel member open end 16. The fourth side 28 of the channel member 12 is provided with an opening 50 near the closed end 14 of the channel member. An additional wing-nut 46 may be attached to the free end of the remaining, or lower, screw 44 inside the channel member 12 by access through the channel member opening 50 of the two upright edges 48, 49, the first upright edge 48 of the first panel member 40 extends beyond the second side 24 of the channel member 12.

A second panel member 60, having holes 64 therein alignable with the holes 34 in the channel member second side 24, is attached to the channel member second side by the screws 44, and wing-nuts 46 similarly to the attachment of the first panel, described above. Of two upright edges 66, 68, the first upright edge 66 of the second panel member 60 extends beyond the third side 26 of the channel member; the second upright edge 68 being adjacent the first panel member 40.

Similarly, a third panel member 70, having holes therein alignable with the holes 36 in the channel member third side 26, is attached to the channel member third side by the screws 44, and wing-nuts 46, with access to the interior of the channel member through the channel member open end 16 and the opening 50 of two upright edges 72, 74, the first upright edge 72 of the third panel member 70 extends beyond the fourth side 28 of the channel member; the second upright edge 74 being adjacent the second panel member 60.

A fourth panel member 80 is provided, having holes 88 therein alignable with the upper two of the holes 38 of the fourth side 28 of the channel member 12. The fourth panel member is further provided with a clip means 82 extending from an interior side 84 of the fourth panel member 80 and adapted to be received by the channel member opening 50 and thereby attach to portions of the fourth side 28 proximate the opening 50 to attach the fourth panel 80 to the fourth side of the channel member. To further secure the connection, screws 44 are passed through the aligned holes 88, 38 and wing-nuts 46 applied to the screws by way of the channel member open end 16. Of two upright edges 86, 89 of the fourth panel member 80, the first upright edge 86 extends beyond the first side 22 of the channel member, the second upright edge 89 being adjacent the third panel member 70.

With the four panel members 40, 60, 70 and 80 secured to the channel member 12, the assembly is completed by closing the open end 16 of the channel member 12 with a cap member 90.

As assembled, the first and second panel members 40, 60, and the base member 2, form a first display area, the second and third panel members 60, 70, and the base member 2, form a second display area, the third and fourth panel members 70, 80, and the base member, form a third display area, and the fourth and first panel members 80, 40, and the base member, form a fourth display area.

The assembly may be quickly and easily erected and, upon completion, the openings are closed and only display surfaces are subject to sight.

It is to be understood that the present invention is by no means limited to the particular construction herein disclosed and/or shown in the drawings, but also comprises any modifications or equivalents within the scope of the disclosure.

For example, while a four-sided fixture has been described for illustrative purposes, it will be apparent that the concept of the invention is readily applicable to three-or-more-sided fixtures, in which case the invention merely requires an appropriately shaped channel member and base portion, and an appropriate number of panel members; the method would remain essentially as stated above, the variance in the number of steps depending upon the variance in the number of panel members used.

As a further example, the base member 2 may be entirely omitted and the channel member 12 and the sides 22, 24, 26, 28 used in conjunction with a shelf-like horizontal support.

Having thus described my invention what I claim as new and desire to secure by Letters Patent of the United States is:

1. A display fixture comprising a hollow channel member having a plurality of planar side walls and a last planar side wall, a panel member fixed to each of said plurality of planar side walls, respectively, fastener members extending through said panel members and said plurality of side walls into said channel member, fastener lock members disposed on said fastener members within said channel member, said channel member having a free end adapted to be open for access to a portion of said fastener members and manipulation of a portion of said fastener lock members, said last planar side wall having an opening therein near its end remote from said free end, said opening being adapted for access to a remainder of said fastener members and manipulation of a remainder of said fastener lock members, and a last panel member, clip means fixed to said last panel member, said opening being adapted to receive said clip means, said last side wall adjacent said opening being adapted to interconnect with said clip means to retain said last panel member on said last side wall.

2. A display fixture comprising a base member having a substantially planar surface, a hollow channel member fixed to said base member and upstanding therefrom, said channel member having a plurality of planar side walls and a last planar side wall, a panel member fixed to each of said plurality of planar side walls, respectively, fastener members extending through said panel members and said plurality of side walls into said channel member, fastener lock members disposed on said fastener members within said channel member, said channel member having a free end adapted to be open for access to a portion of said fastener members and manipulation of a portion of said fastener lock members, said last planar side wall having an opening therein near its end remote from said free end, said opening being adapted for access to a remainder of said fastener members and manipulation of a remainder of said fastener lock members, and a last panel member, clip means fixed to said last panel member, said opening being adapted to receive said clip means, said last side wall adjacent said opening being adapted to interconnect with said clip means to retain said last panel member on said last side wall.

3. A display fixture in accordance with claim 2 in which each of said panel members has first and second upright edges, said first edge being adjacent another of said panel members, and said second edge being disposed beyond still another of said panel members, such that any two of said panel members, and a portion of said base member surface therebetween, form a display area.

4. A display fixture in accordance with claim 2 including a removeable cap member adapted for connection to said channel member free end.

5. A display fixture in accordance with claim 3 in which each of said panel member second edges is proximate an edge of said base member.

6. Method for assembling a display fixture, said method comprising the steps of (1) providing a hollow plural-sided channel member open at an upper end, said channel member having in each of its plurality of sides holes adapted to receive fastener members, said channel member having an opening therein proximate a lower end of said channel member, (2) joining to each of said plurality of sides a panel, each of the plurality of panels having holes therein alignable with said channel member holes and adapted to receive fastener members, (3) inserting fastener members through said panel holes and said channel member holes, free ends of said fastener members being disposed in said hollow channel member, (4) by access through said open upper end of said channel member attaching locking members to a portion of said fastener member free ends to secure said panels to said channel member sides, (5) by access through said channel member opening attaching locking members to a remainder of said fastener member free ends to further secure said panels to said channel member sides, (6) providing a last panel having fixed thereto a clip member adapted to engage portions of a last channel member side wall adjacent said opening, and (7) inserting said clip member in said opening to clip said last panel to said last side by engagement of said clip member with said last side wall portions adjacent said opening.

7. Method for assembling a display fixture, said method comprising the steps of (1) providing a base member having a substantially planar horizontal surface, (2) attaching to said base member a hollow plural-sided channel member with said channel member upstanding from said planar surface, said channel member being open at its upper end, said channel member having in each of its plurality of sides holes adapted to receive fastener members, said channel member having an opening therein proximate the lower end of said channel member, (3) joining to each of said plurality of sides a panel, each of the plurality of panels having holes therein alignable with said channel member holes and adapted to receive fastener members, (4) inserting fastener members through said panel holes and said channel member holes, free ends of said fastener members being disposed in said hollow channel member, (5) by access through said open upper end of said channel member attaching locking members to a portion of said fastener member free ends to secure said panels to said channel member sides, (6) by access through said channel member opening attaching locking members to a remainder of said fastener member free ends to further secure said panels to said channel member sides, (7) providing a last panel having fixed thereto a clip member adapted to engage portions of a last channel member side wall adjacent said opening, and (8) inserting said clip member in said opening to clip said last panel to said last side by engagement of said clip member with said last side wall portions adjacent said opening.

8. The method for assembling a display fixture in accordance with claim 7, including the additional step of attaching a cap member to said channel member upper end to close said channel member.

* * * * *